US008037729B2

(12) United States Patent
Mantovan et al.

(10) Patent No.: US 8,037,729 B2
(45) Date of Patent: Oct. 18, 2011

(54) FINISHING MONOBLOCK FOR A BILLET LAMINATION PLANT FOR PRODUCING HIGH-QUALITY WIRE RODS

(75) Inventors: Gianfranco Mantovan, Varese (IT); Roberto Formentin, Varese (IT)

(73) Assignee: Siemens VAI Metals Technologies S.R.L., Marnate (Varese) (IT)

( * ) Notice: Subject to any disclaimer, the term of this patent is extended or adjusted under 35 U.S.C. 154(b) by 968 days.

(21) Appl. No.: 11/628,013

(22) PCT Filed: Jun. 21, 2005

(86) PCT No.: PCT/EP2005/006703

§ 371 (c)(1),
(2), (4) Date: Nov. 27, 2006

(87) PCT Pub. No.: WO2006/000381

PCT Pub. Date: Jan. 5, 2006

(65) Prior Publication Data

US 2008/0011038 A1 Jan. 17, 2008

(30) Foreign Application Priority Data

Jun. 24, 2004 (IT) ..... MI2004A01268

(51) Int. Cl.
*B21B 13/08* (2006.01)
*B21B 13/12* (2006.01)
*B21B 13/00* (2006.01)

(52) U.S. Cl. ..... 72/238; 72/235; 72/224

(58) Field of Classification Search ..... 72/235, 72/224, 239, 238, 237, 249, 225, 250
See application file for complete search history.

(56) References Cited

U.S. PATENT DOCUMENTS

| | | | | |
|---|---|---|---|---|
| 3,665,746 | A * | 5/1972 | Eibe | 72/239 |
| 5,442,946 | A * | 8/1995 | Yokoo et al. | 72/235 |
| 5,577,405 | A | 11/1996 | Shore et al. | |
| 5,595,083 | A * | 1/1997 | Shore | 72/234 |
| 5,823,036 | A * | 10/1998 | Matsunaga | 72/239 |
| 6,053,022 | A * | 4/2000 | Shore | 72/235 |
| 6,148,654 | A * | 11/2000 | Jensen et al. | 72/181 |
| 6,402,010 | B1 * | 6/2002 | Virginio et al. | 228/158 |
| 6,546,776 | B2 * | 4/2003 | Wesolowski et al. | 72/235 |
| 7,191,629 | B1 * | 3/2007 | Shore et al. | 72/235 |
| 2002/0100306 | A1 | 8/2002 | Wesolowski et al. | |

OTHER PUBLICATIONS

International Search Report, Sep. 26, 2005.

* cited by examiner

*Primary Examiner* — Edward Tolan
*Assistant Examiner* — Mohammad I Yusuf
(74) *Attorney, Agent, or Firm* — Laurence A. Greenberg; Werner H. Stemer; Ralph E. Locher

(57) ABSTRACT

A finishing monoblock for a billet lamination plant of the type comprises a plurality of lamination cages (G1Gn) arranged in sequence suitable for forming a lamination line and actuated by a pair of mechanical transmissions (22, 22') actuated through at least one command reducer (23) for the lamination of the billet. According to the invention, said monoblock comprises at least one first module (M1) and a second module (M2', M2"), of which at least one is disengageable from the lamination line through a pair of detachable joints (40).

10 Claims, 21 Drawing Sheets

32
32
29
H1
C"
28'
23'
F
31
31
H2
25'
H1
C'
H2
28'

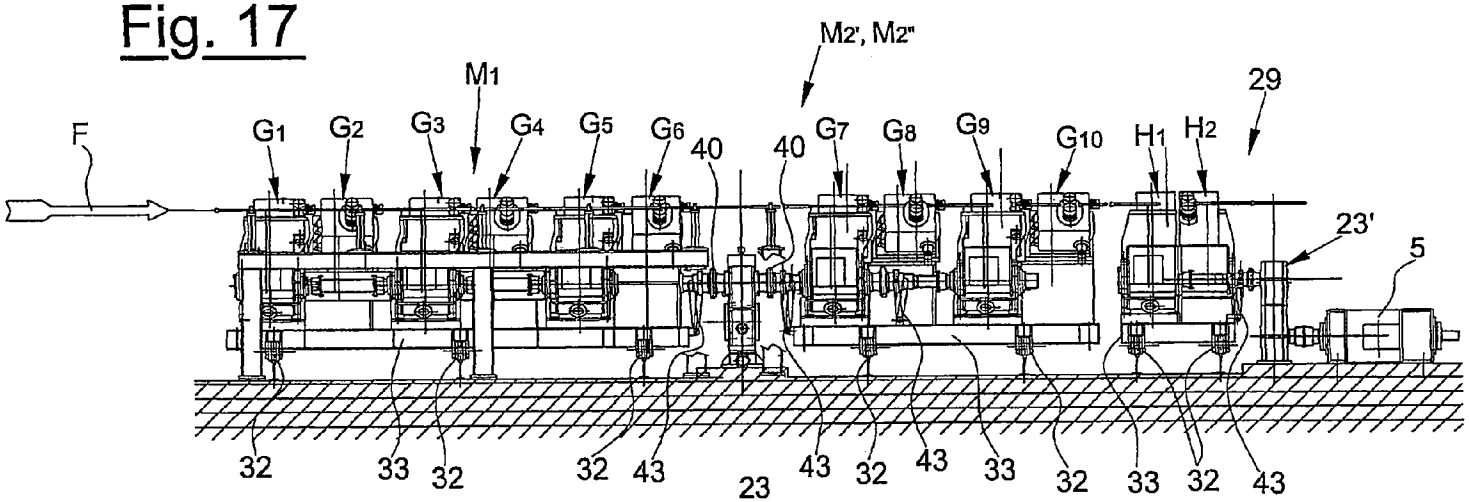
Fig. 17
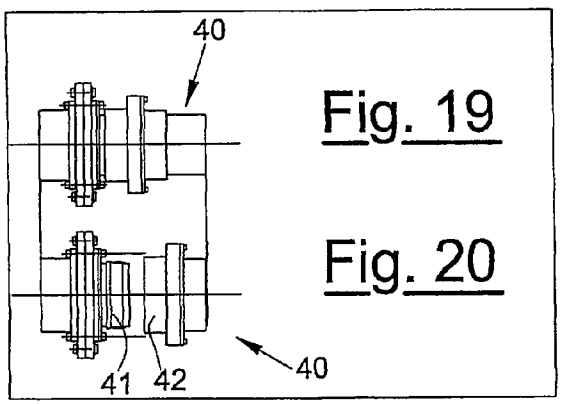
Fig. 19
Fig. 20

FINISHING MONOBLOCK FOR A BILLET LAMINATION PLANT FOR PRODUCING HIGH-QUALITY WIRE RODS

The present invention refers to a finishing monoblock for a billet lamination plant for producing high-quality wire rods.

In a lamination plant or rolling mill of billets for producing high-quality wire rods, according to established technology, a billet previously taken to a suitable temperature for hot lamination between 750° C. and over 1000° C. is subjected to lamination so as to gradually reduce its section to the desired value.

In the production of high-quality and special steel wire rods, high mechanical characteristics, like resistance to breaking and to yielding and deformability in drawing, are equally of particular importance.

In a rolling mill for producing wire rod, one of the critical sections thus consists of the finishing monoblock that, through a plurality of lamination cages, reduces the size of the billet producing the wire rod to be sent to the calibrator or directly to the winding machine.

To give the wire rod a circular section or in general a regular profile, the lamination rollers or cylinders of the lamination cages are arranged alternately staggered for example by 90 degrees, so as to laminate the billet in the final steps with subsequent deformations for example with round-oval-round section.

A monoblock according to the prior art is schematically illustrated in FIGS. 1 to 3 in a schematic perspective view, in a top side view with respect to the lamination axis, indicated by the arrow F, and once again in a perspective view with the calibrator arranged downstream of the monoblock, respectively.

With reference to such prior art, a lamination monoblock 1 comprises two parallel mechanical transmissions, a first transmission 2 and a second transmission 2', connected through a command reducer 3 in turn connected through gears 4 to the work driving motor 5.

The mechanical transmissions are equipped with pairs of conical gears 6 and with gears 7 that transmit the rotation in cascade to the lamination cylinders 8 of the various cages G1, G2, . . . , Gn of the lamination monoblock 1.

In the illustrated example, such a monoblock foresees ten lamination cages G1-G10 in succession, commanded alternately through the two transmissions 2 and 2', so that the first transmission 2 commands the odd cages G1, G3, . . . , G9, which produce a reduction in section transforming the round bar going in into an oval bar, whereas the second transmission 2' commands the even cages, G2, G4, . . . , G10, which produce a reduction in section transforming the oval bar going in into a round bar.

In current machines an assembly combination of the lamination cylinders are used to produce different diameters of wire rod, normally starting from the largest sizes, in other words starting with the cages G1 and G2 farthest from the command to then continue with the subsequent cages, up to the predetermined diameter.

In a machine schematically illustrated in FIG. 3, downstream of such a monoblock, the calibrator 9 is arranged equipped with two cages H1 and H2 and relative apparatuses comprising the mechanical transmissions 2 and 2' actuated by the command reducer 3 in turn connected through gears 4 to the work driving motor 5', the pair of conical gears 6 and of gears 7 transmitting the rotation in cascade to the calibration cylinders 8'.

Since the mass of product going in and the mass of product going out, in a unit time, must necessarily be identical, during lamination there is an increase in linear speed of the billet to compensate for the reduction in section that involves an increase in length thereof.

The cylinders in the various cages therefore generally rotate at different speeds increasing from the first G1 to the last G10.

In machines according to the prior art, there is a disadvantageous condition, exemplified as follows.

When the required size allows a product to be laminated, finishing it, for example, at the eighth cage, in the case illustrated and described previously of a group of 10 cages, to maximise the lamination speed at the eighth cage, given the mechanical configuration of the group, the tenth cage reaches very high speeds and, furthermore, turning freely, in other words without its mechanical members being engaged.

In such operating conditions the mechanical parts tend to wear quickly.

If, for example, one laminates at a speed of 90 m/s at the eighth cage, the tenth cage rotates at a speed of about 140 m/s turning freely.

This harmful situation is currently solved by limiting the rotation speed in the eighth cage to 70-75 m/s so as not to exceed the speed of 115-120 m/s in the tenth cage turning freely.

The speed limitation is also necessary when the product is already dimensionally finished right from the sixth or else the fourth or even the second cage.

Therefore, the lamination speeds must necessarily be limited according to the maximum speed turning freely permitted in the last cage.

Another drawback, inherent to rolling mills according to the prior art, is relative to the fact that to laminate a different diameter, for example a smaller subsequent diameter, it is necessary to stop the lamination line, disassemble the lamination rollers and the relative guide apparatuses, assemble the rollers and the apparatuses for the new diameter to be produced and take care of adjusting the opening of the rollers themselves.

Such operations are carried out with the lamination line stopped.

The same operations are also necessary when large amounts of wire rod with the same diameter are produced, since after a certain working time the wear of the elements forces their replacement. All of these activities take place with the plant stopped and therefore with substantial production loss.

The general purpose of the present invention is, therefore, that of providing a finishing monoblock for a billet lamination plant suitable for maximising the output speed and therefore the production for all diameters of the laminated product.

Another purpose of the present invention is that of providing a finishing monoblock that allows a reduction in energy consumption and wear of the mechanical parts. Also falling within the purposes of the present invention is to provide a finishing monoblock that allows the reduction in stop times of the rolling mill for maintenance and/or exchange of cylinders and relative apparatuses and connected adjustments.

In view of the aforementioned purposes, according to the present invention, it has been thought of to make a rolling mill for wire rod having the characteristics outlined in the attached claims.

The structural and functional characteristics of the present invention as well as its advantages compared to the prior art shall become even clearer from an examination of the following description, referring to the attached schematic drawings, in which:

FIG. 17 is a schematic top view of a monoblock according to a different embodiment of the invention;

Figure 1:
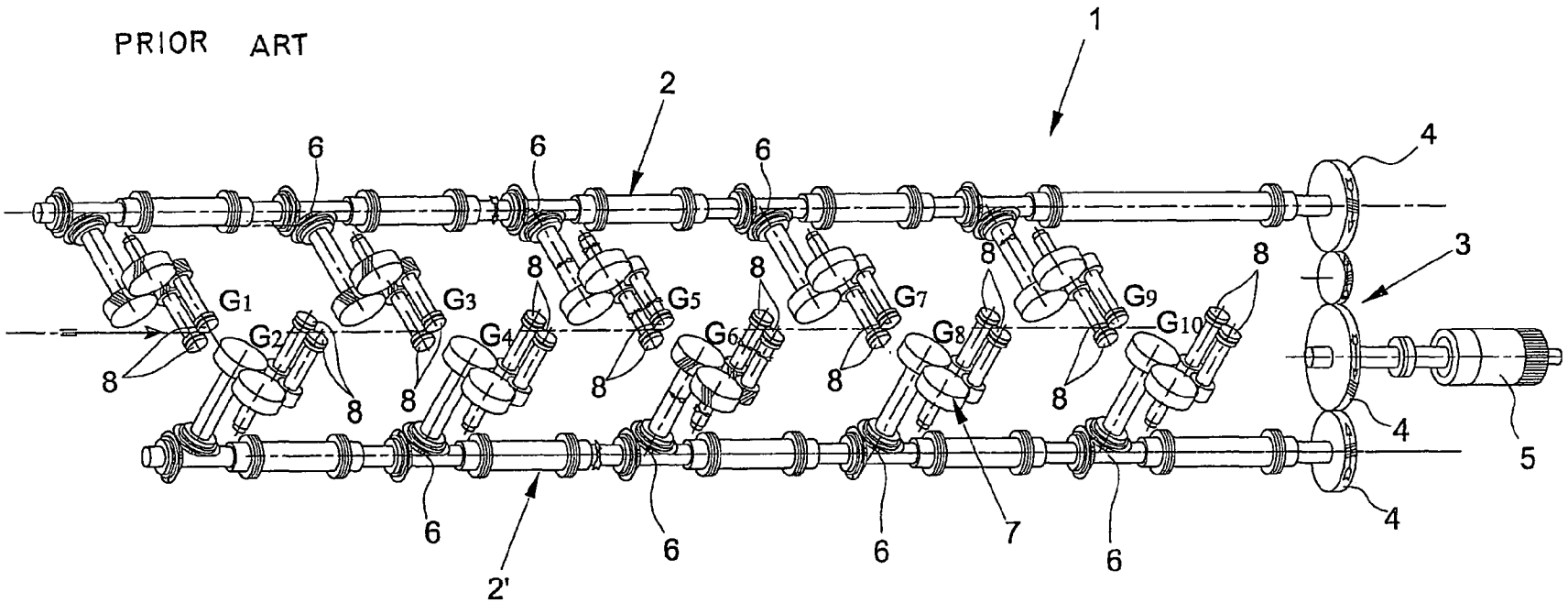
Fig. 1 PRIOR ART
FIGS. 1 to 3 are schematic views of finishing monoblocks for billet lamination plants according to the prior art.
Figure 2:
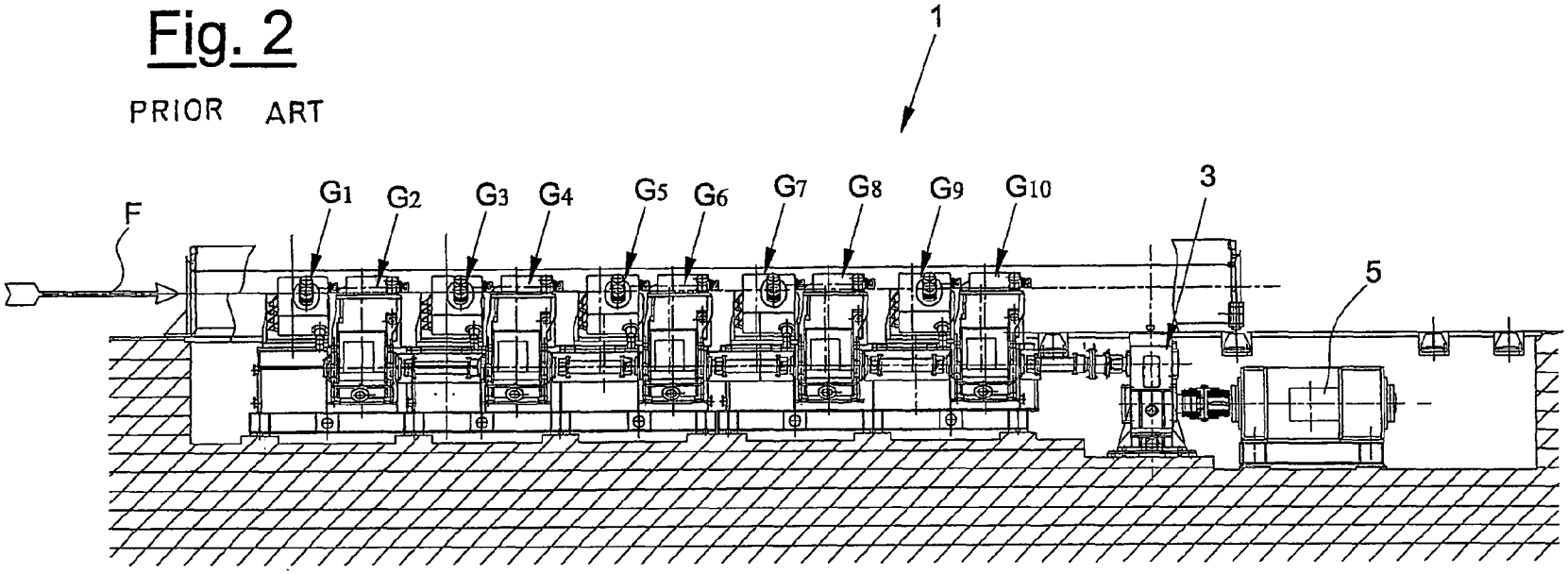
Fig. 2 PRIOR ART
Figure 3:
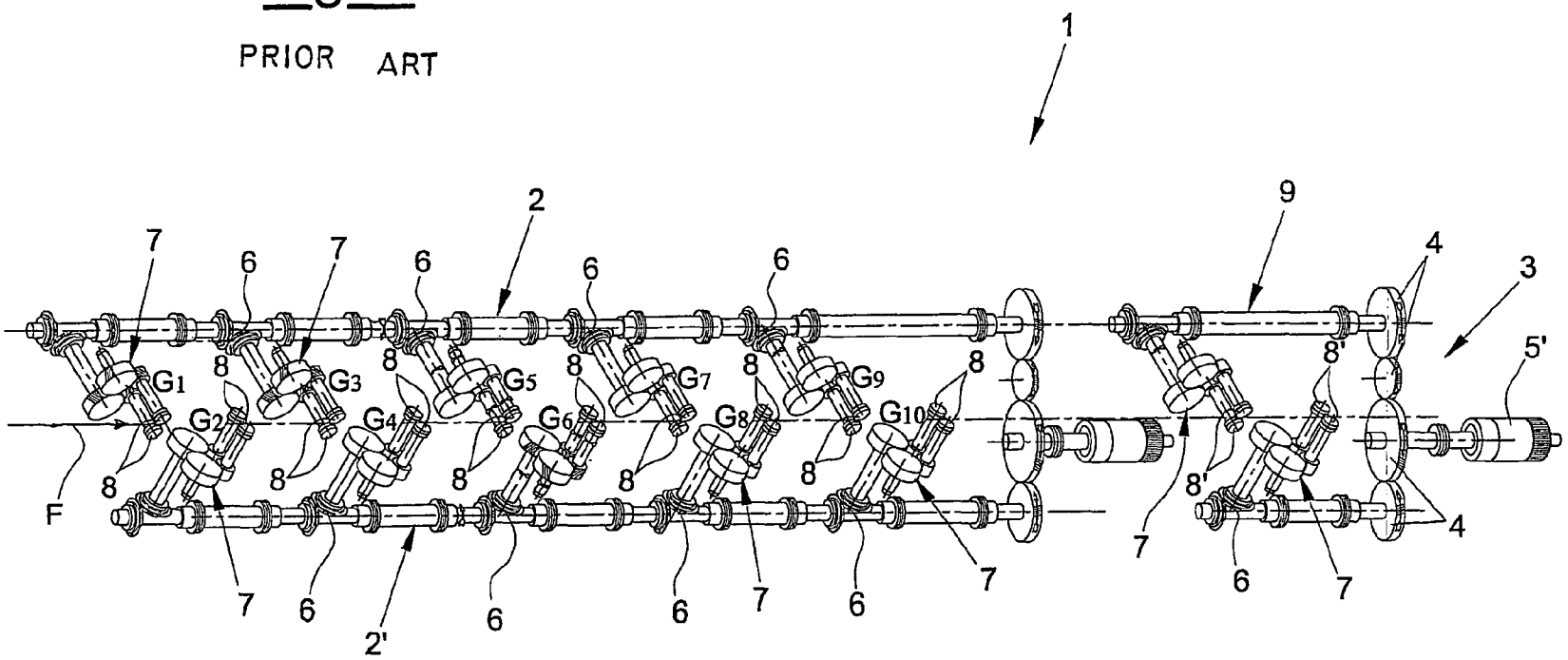
Fig. 3 PRIOR ART
Figure 4:
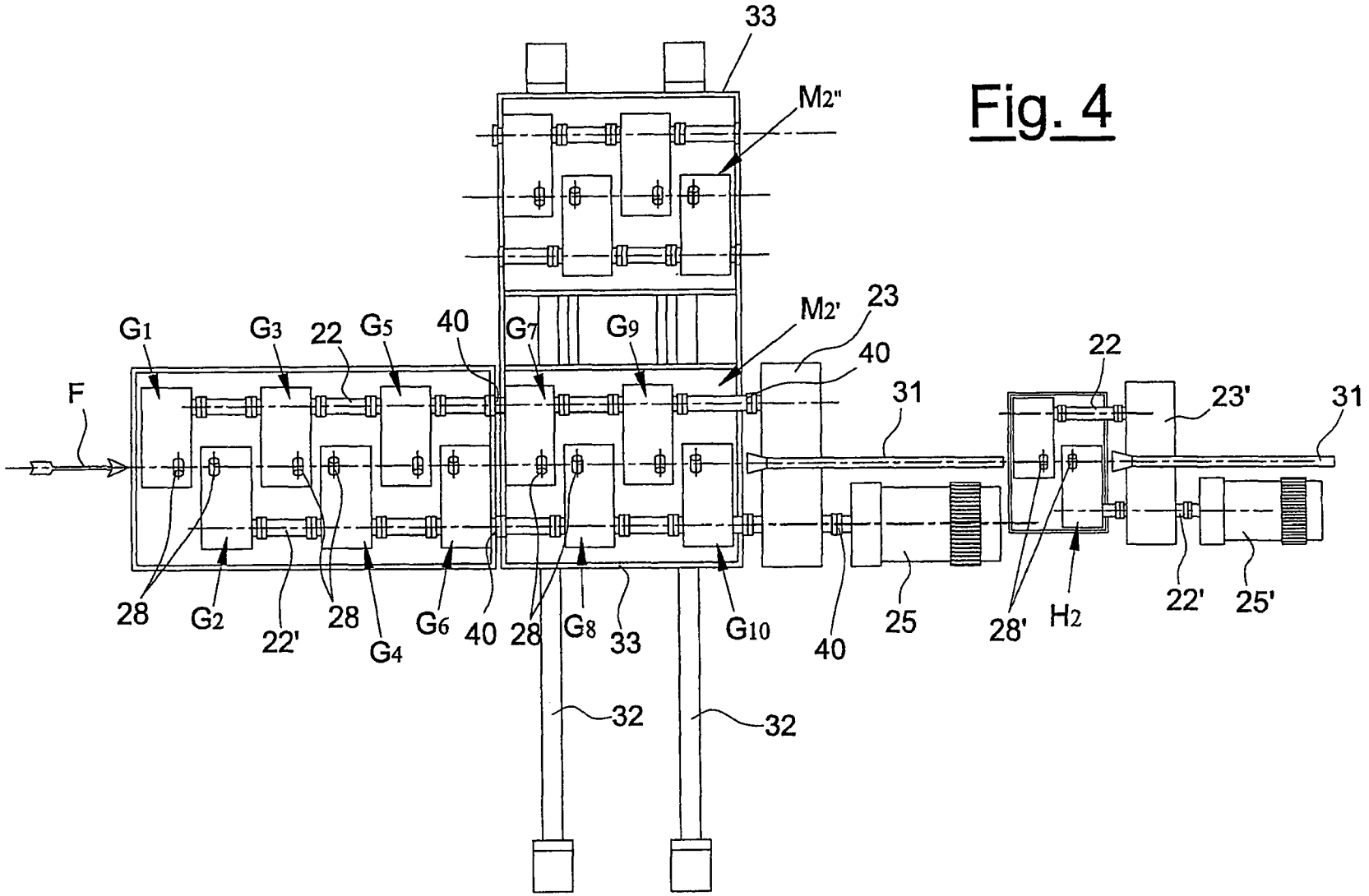
FIG. 4 is a schematic plan view of a finishing monoblock according to an embodiment of the invention in a first way of operating.
Figure 5:
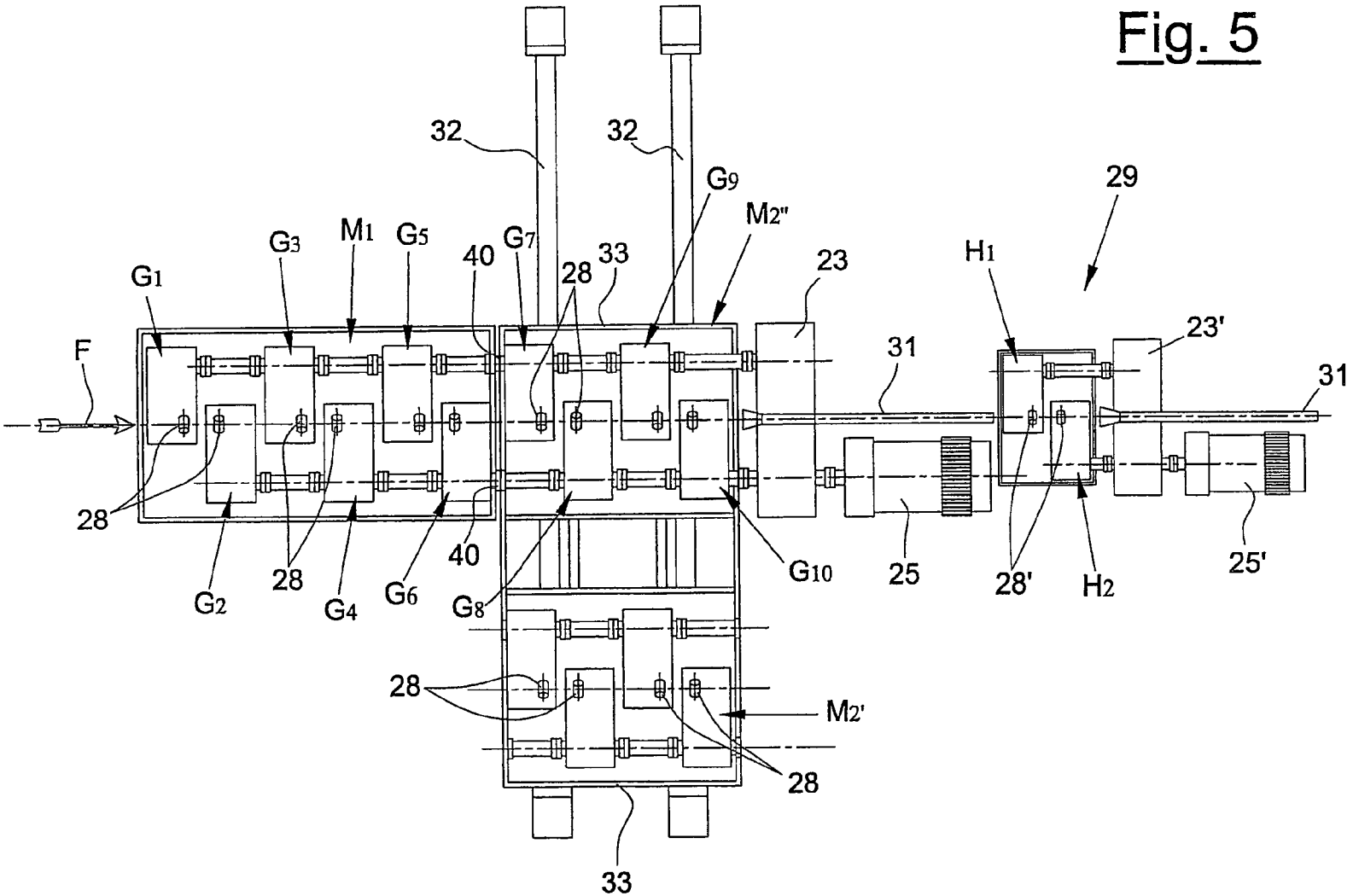
FIG. 5 is a schematic plan view of the finishing monoblock of FIG. 4 in a second way of operating.

FIGS. 18*a*-18*d* are schematic plan views of the monoblock of FIG. 17 in different operating positions;

FIGS. 19 and 20 illustrate a detail of the monoblock according to the invention in two different operating positions.

With reference to FIGS. 4 to 9 and 19, 20, a finishing monoblock for a billet lamination plant comprises at least one first module M1 and a second module M2', M2".

The modules M1, M2', M2" comprise a plurality of lamination cages G1, G2, G3, Gn arranged in sequence suitable for forming a lamination line for the lamination of the billet in input along the direction indicated by the arrow F, so as to make a wire rod, or generally a laminated product, of predetermined section.

The modules comprise two parallel mechanical transmissions, a first transmission 22 and a second transmission 22', such transmissions are in turn connected and actuated through at least one command reducer 23 arranged downstream of the second module M2', M2" in turn connected through gears 24 to a work driving motor 25 arranged in series with the monoblock. The mechanical transmissions 22, 22' are equipped with pairs of conical gears 26 and with gears 27 that transmit the rotation in cascade to the lamination cylinders 28 of the various cages G1, G2, . . . , Gn of the modules M1, M2', M2" of the lamination monoblock.

In the illustrated example such a monoblock foresees ten lamination cages G1-G10 in succession, commanded alternately through the two transmissions 22 and 22', so that the first transmission 22 commands the odd cages G1, G3, . . . , G9 whereas the second transmission 22' commands the even cages, G2, G4, . . . , G10.

Between the first module M1 and the second module M2, M2' at least two detachable joints 40 are foreseen comprising (also with reference to FIGS. 19 and 20) a male fitting portion 41 and a female fitting portion 42 and operable through levers 43.

Such joints are arranged along the transmissions 22 and 22', so as to allow the quick disconnection and reconnection of the first module M1 with the second M2' and M2".

The second module is made in the form of two substantially identical groups M2' and M2", in other words comprising two series of cages that in this case are the last four cages G7-G10 exactly replicated.

Such groups are able to slide since they are supported by at least one trolley 33 that can translate on suitably arranged guides 32.

Advantageously, in such a way it is possible to quickly exchange one group of the second module with the other interrupting processing for a minimum amount of time.

To make the lamination product advance in a guided way to the output of the second module, a mouthed duct 31 is foreseen that crosses the command reducer 23 and guides the wire rod to a calibrator 29.

Such a calibrator 29 is arranged downstream of the second module M2, M2' and is in turn equipped with two cages H1 and H2 and relative apparatuses comprising the mechanical transmissions 22 and 22' actuated by its own command reducer 23' in turn connected through gears 24 to the work driving motor 25'.

For the transmission of the rotation to the calibration cylinders 28' there are the pairs of conical gears 26 and gears 27.

Figure 6:
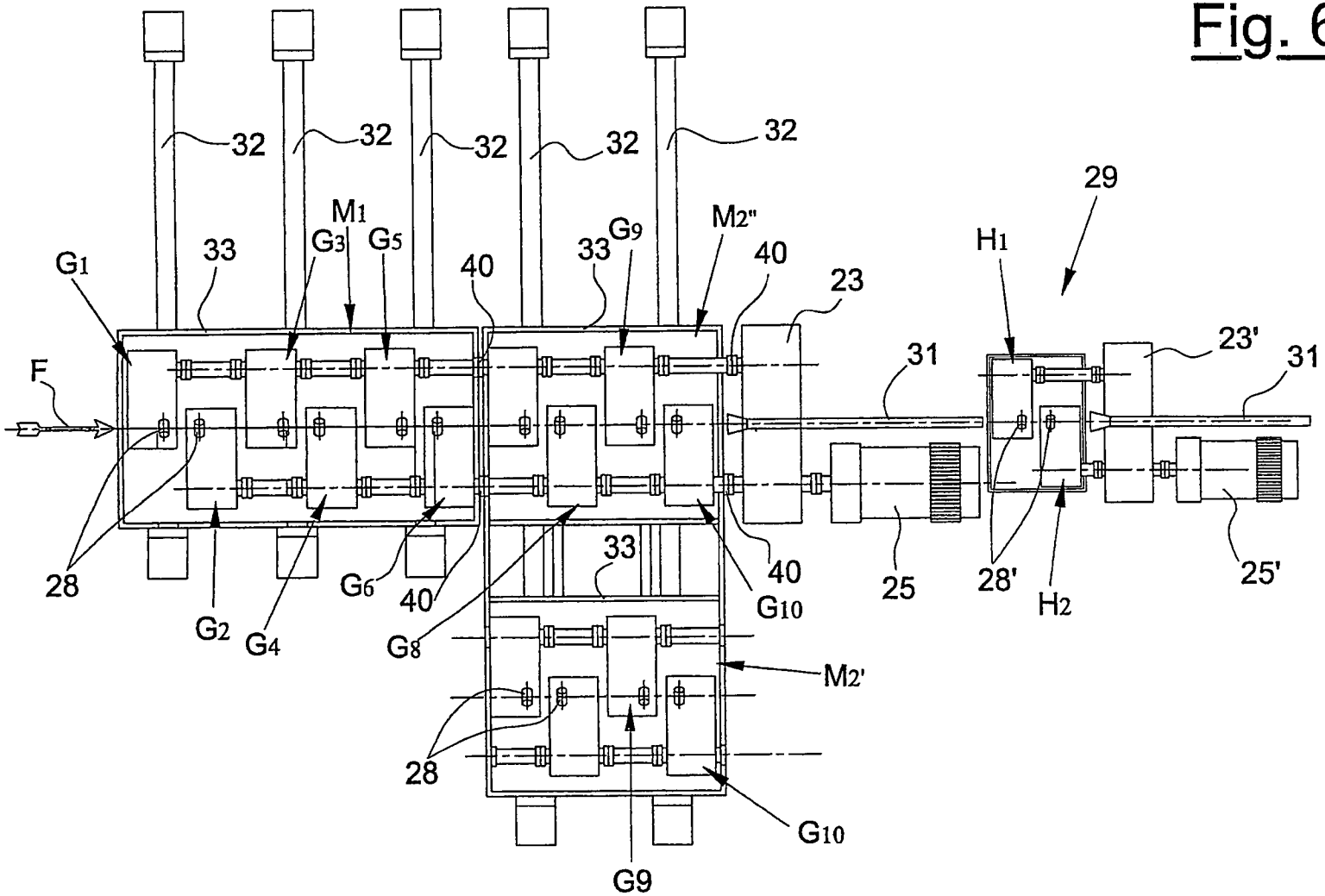
FIG. 6 is a schematic plan view of a finishing monoblock according to a different embodiment of the invention in a first way of operating.
Figure 7:
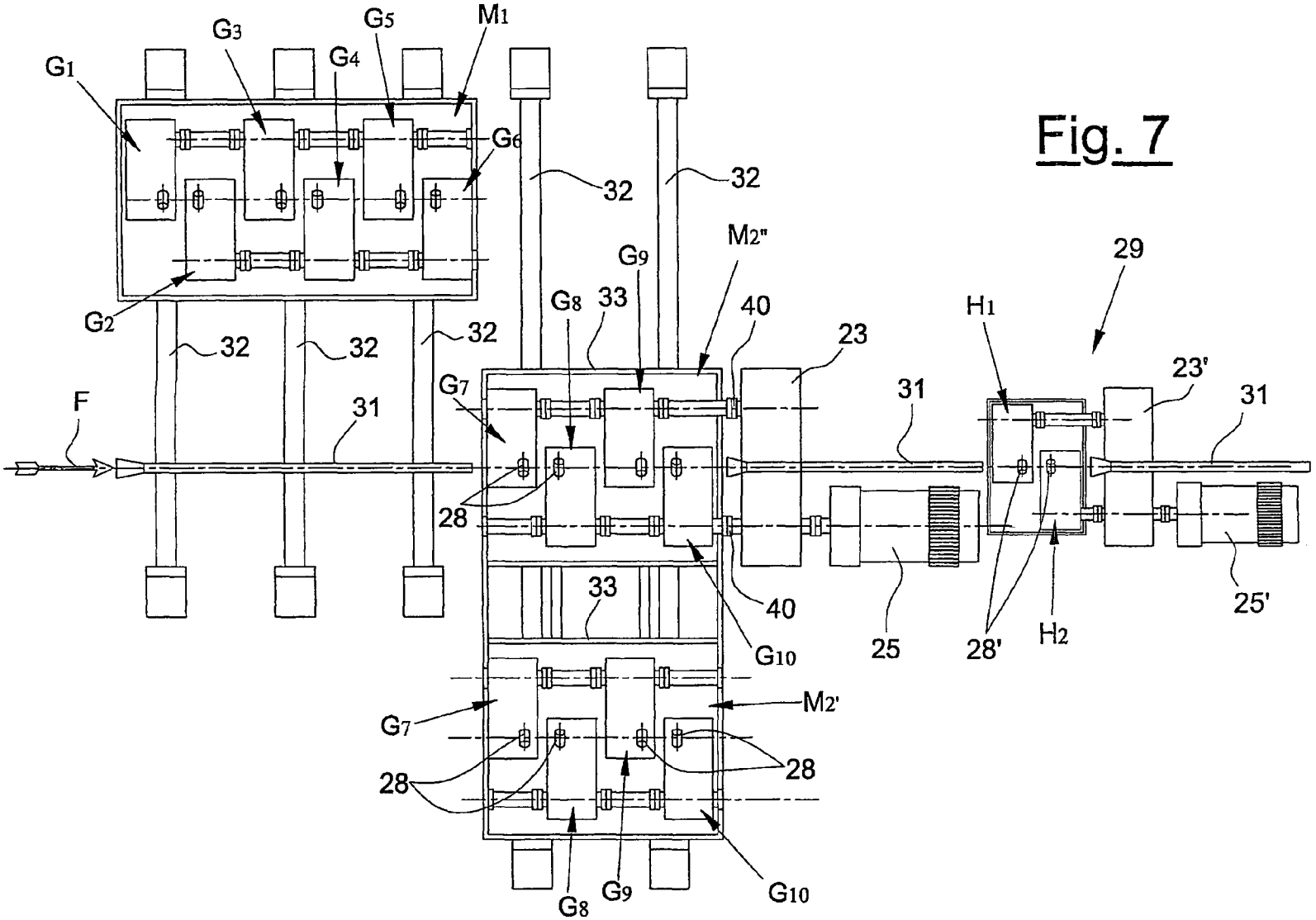
FIG. 7 is a schematic plan view of the finishing monoblock of FIG. 6 in a second way of operating.
Figure 8:
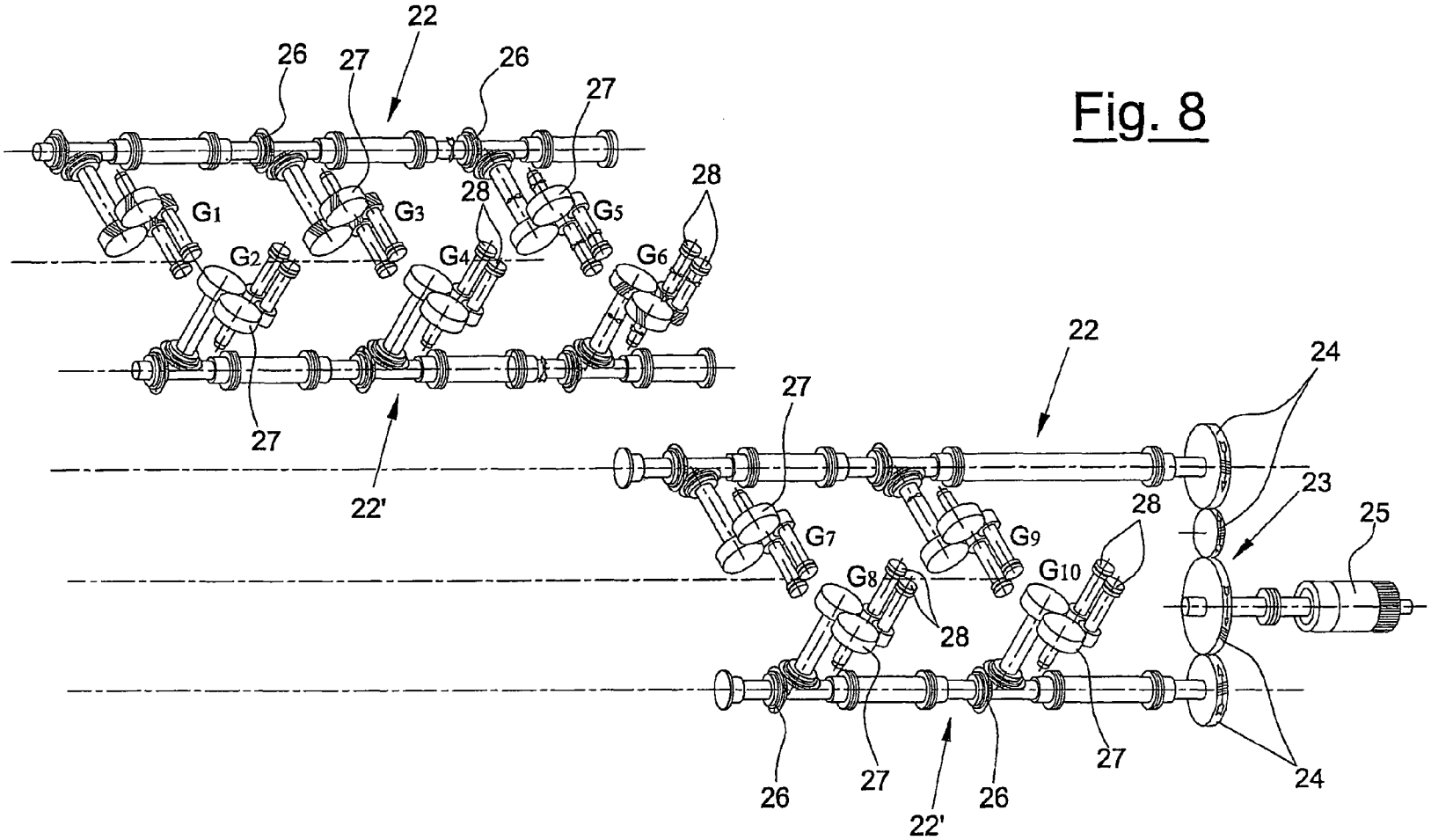
FIGS. 8 and 9 are schematic perspective views of the monoblock according to the invention.
Figure 9:
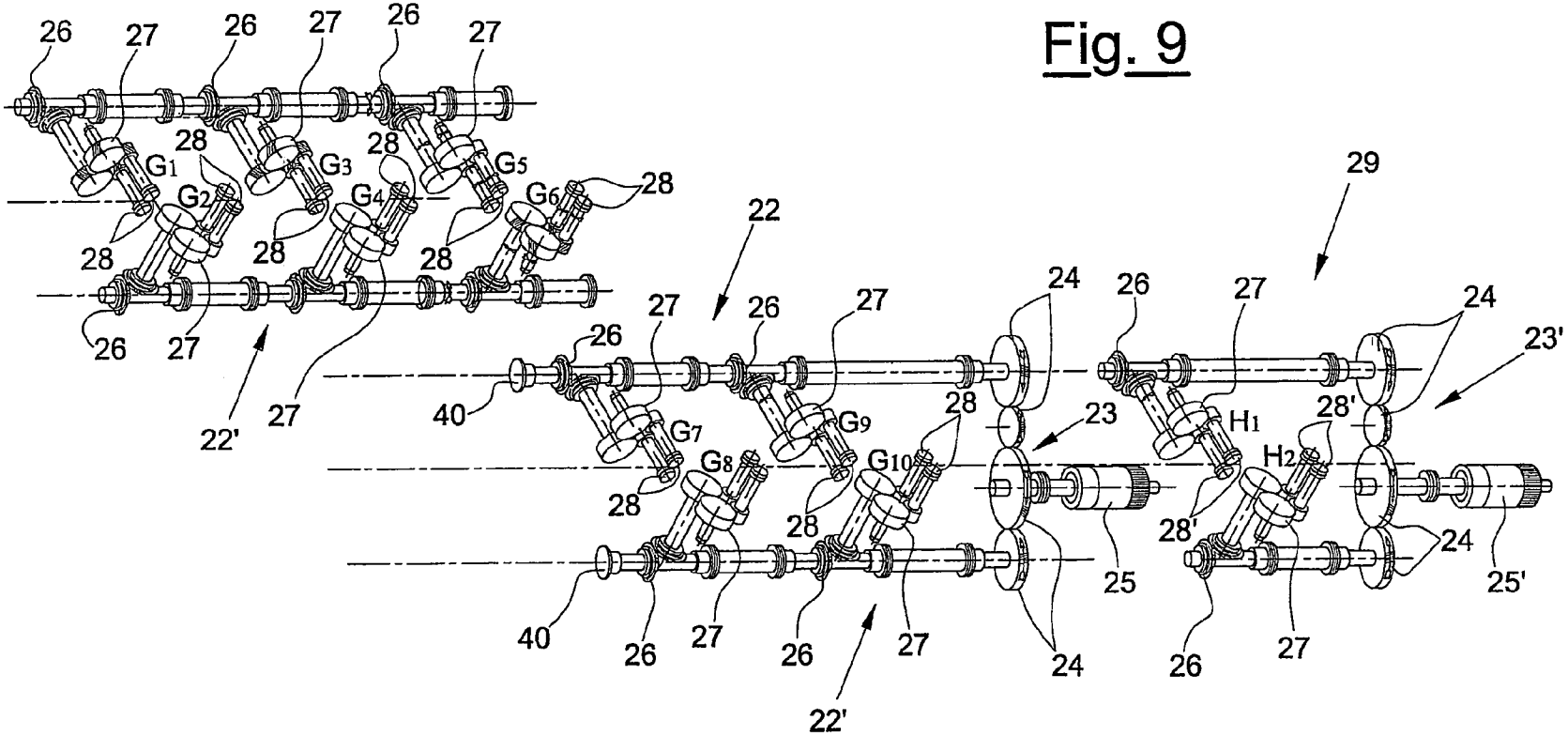

With particular reference to FIGS. 6 and 7 the first module M1 is also made so that it can slide on guides 32 being supported by a trolley 33.

In such a way it is possible to avoid its use by laminating the billet directly starting from the second module. A mouthed duct 31 is, therefore, foreseen to guide the billet entering into the second module and another guides the wire rod going out from the calibrator beyond the mouthed duct 31 that guides the wire rod from the second module to the calibrator.

Figure 10:
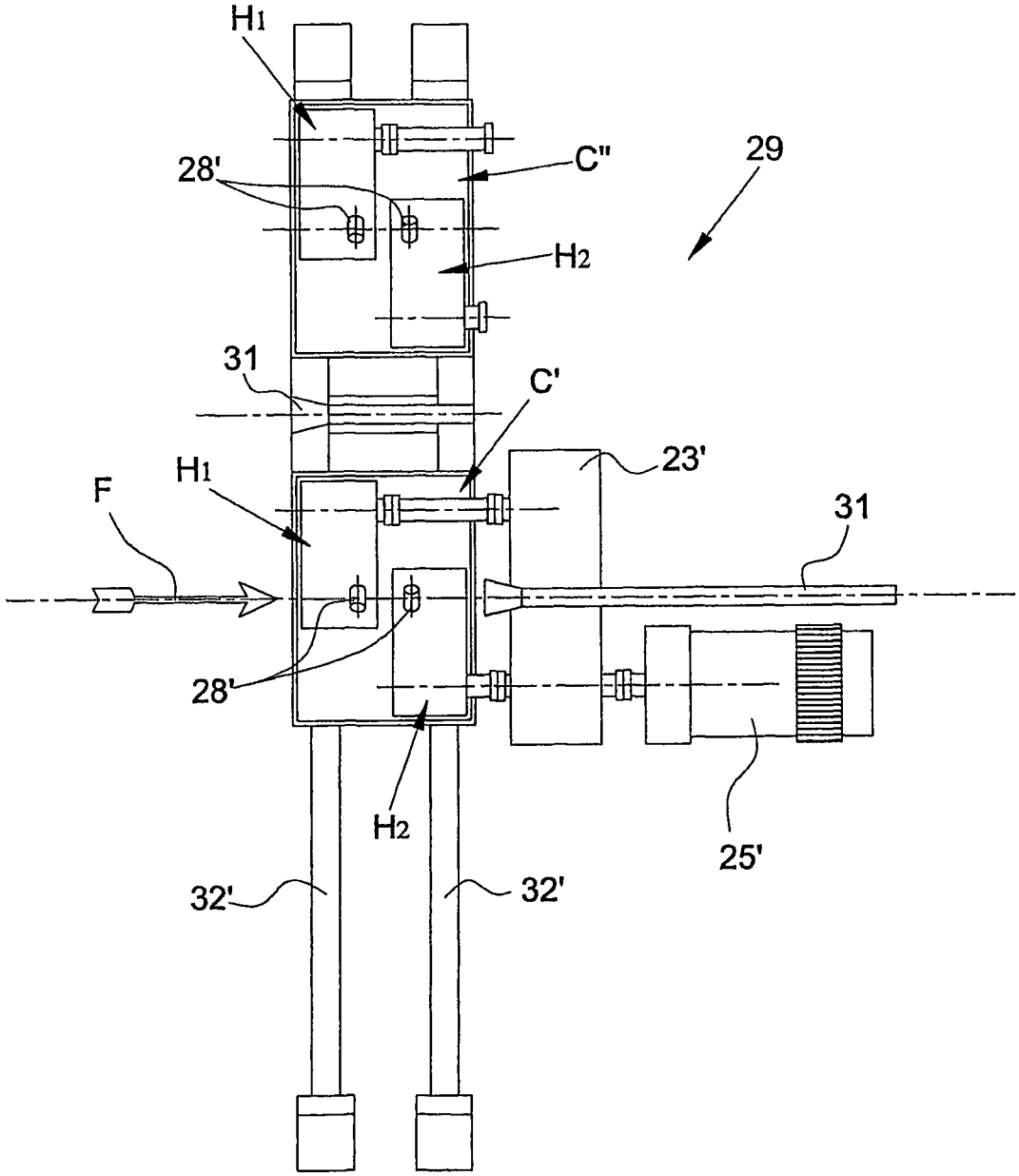
FIGS. 10 to 12 are schematic plan views of a calibrator to be connected to the finishing monoblock according to the invention, in three different operating positions.
Figure 11:
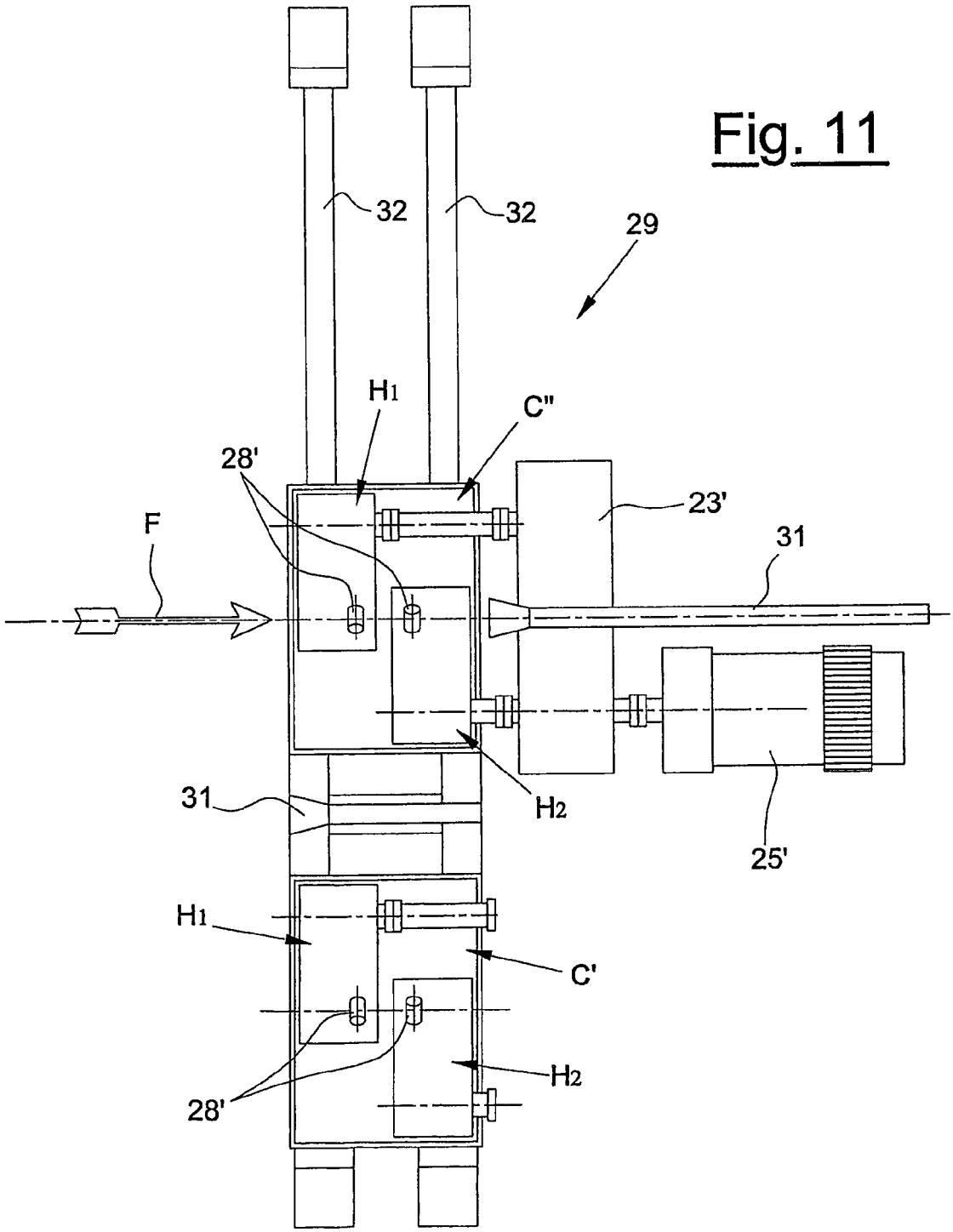
Figure 12:
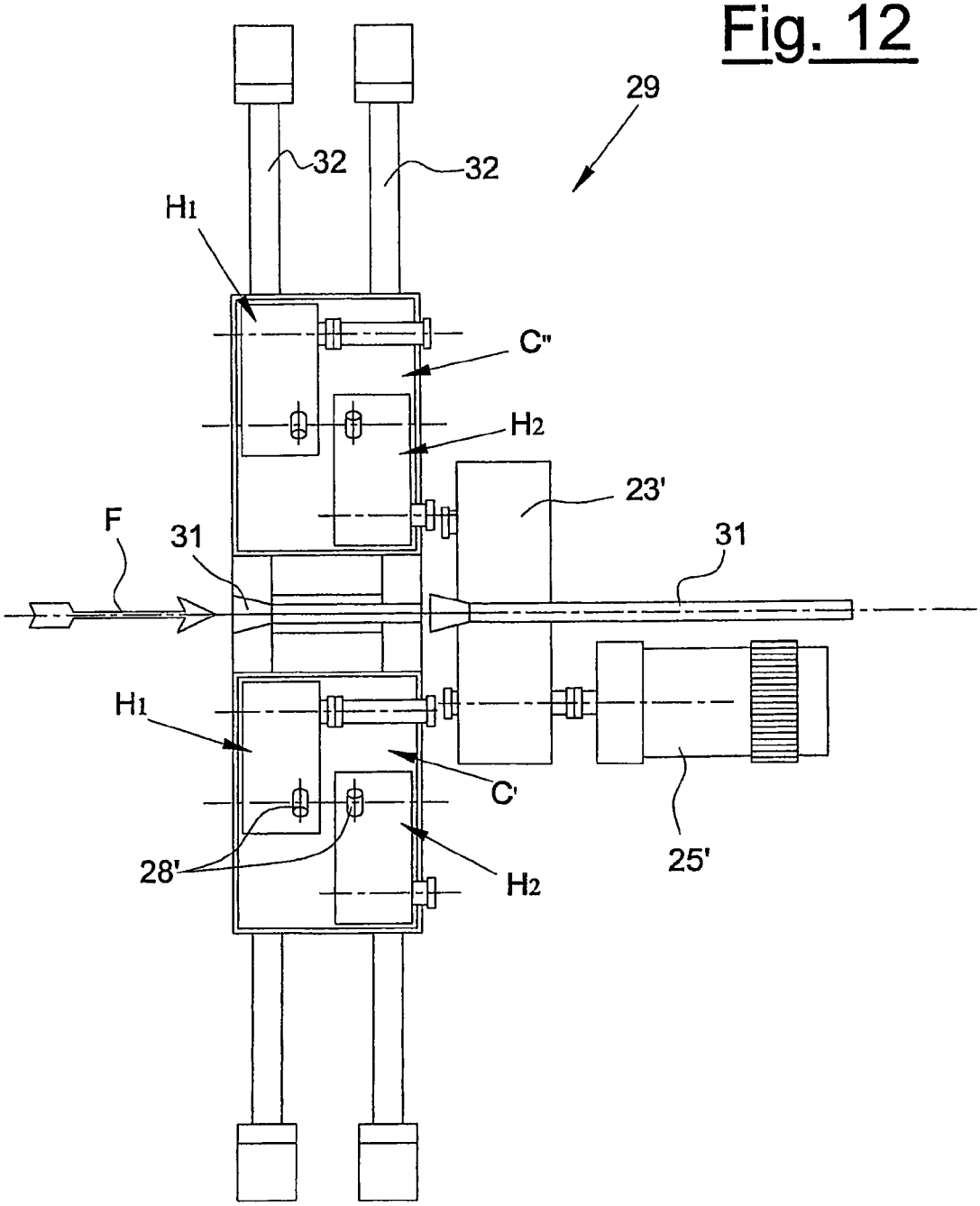
Figure 13:
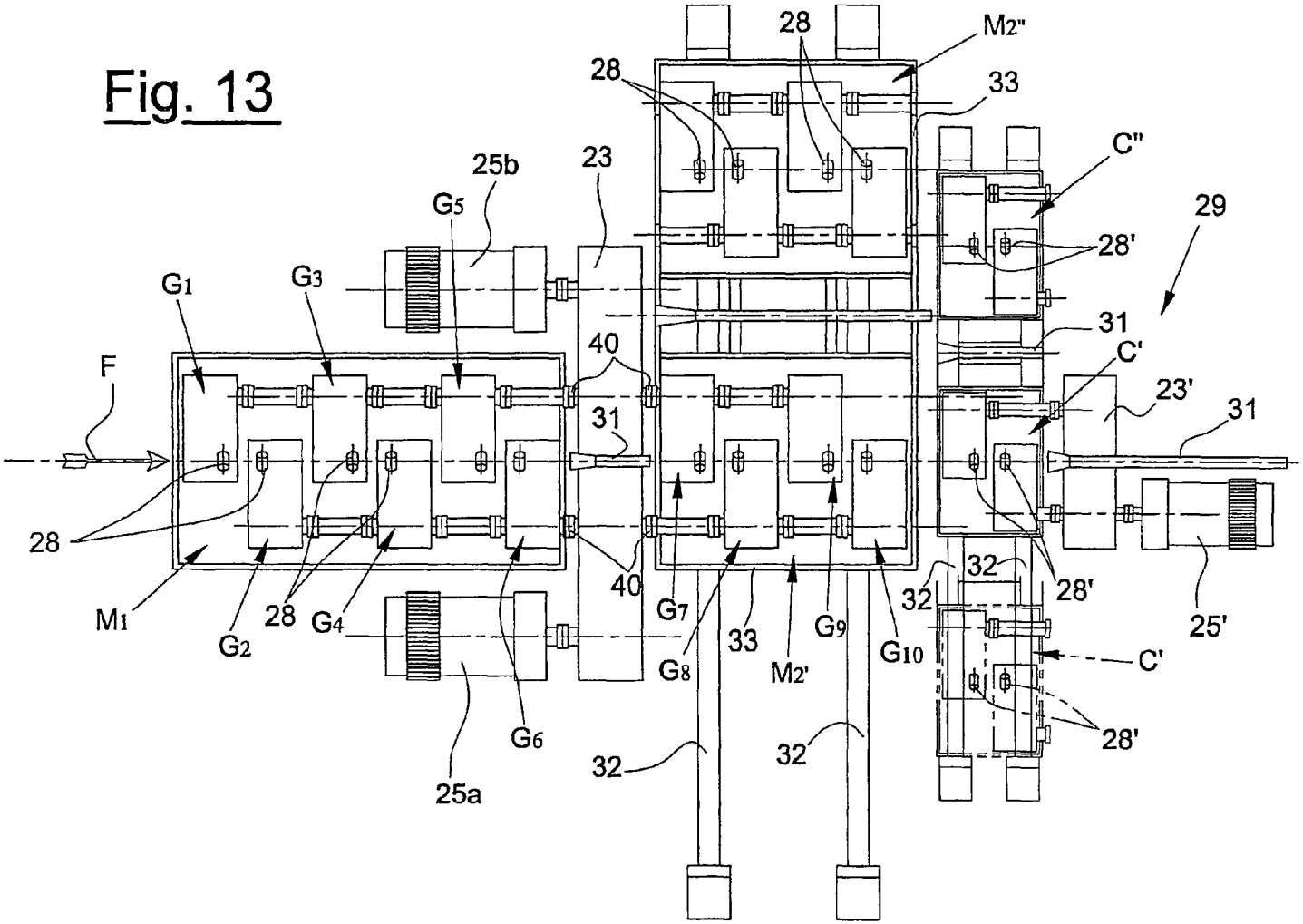
FIGS. 13 to 15 are schematic plan views of a monoblock according to the invention made in a different configuration.
Figure 14:
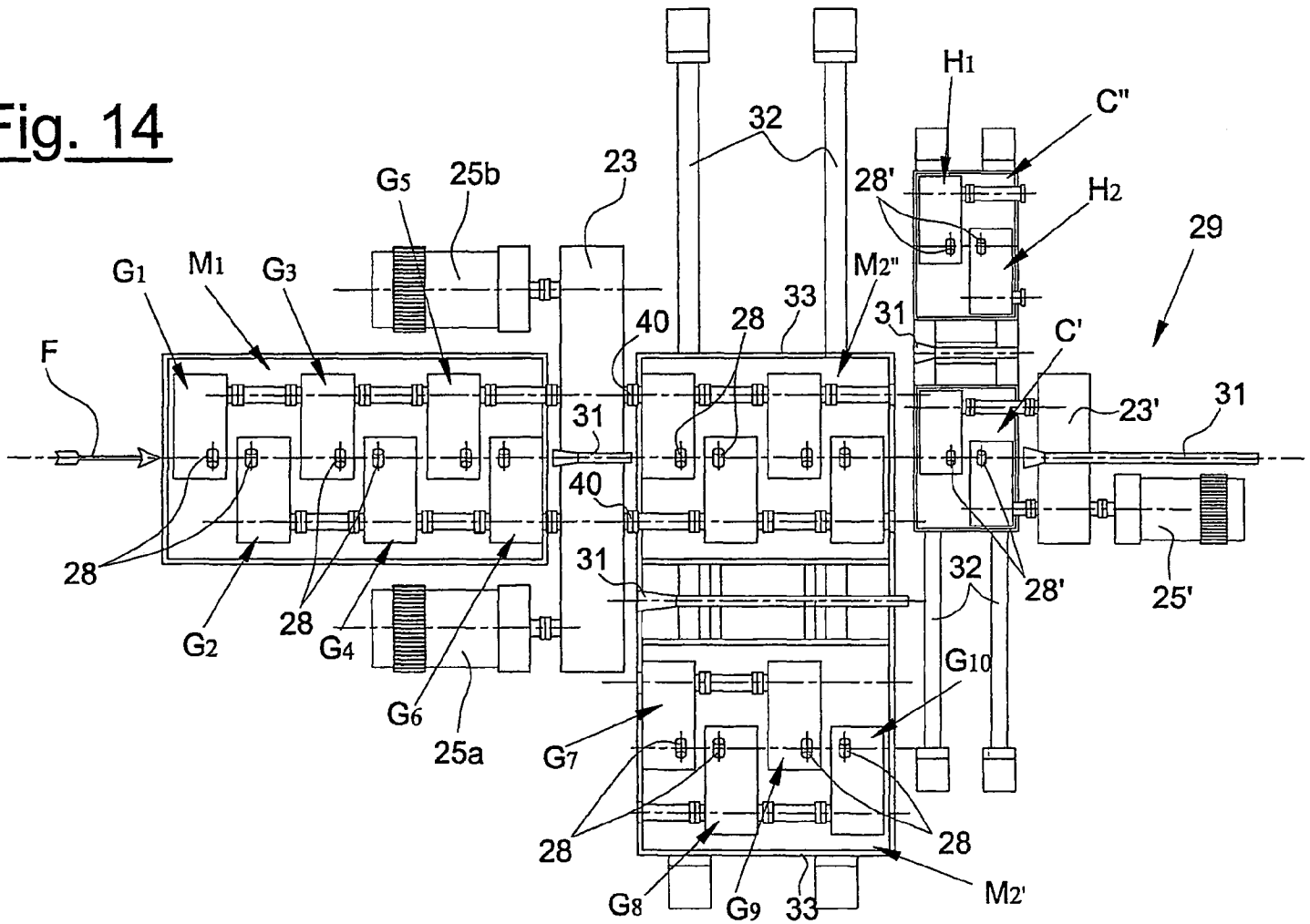
Figure 15:
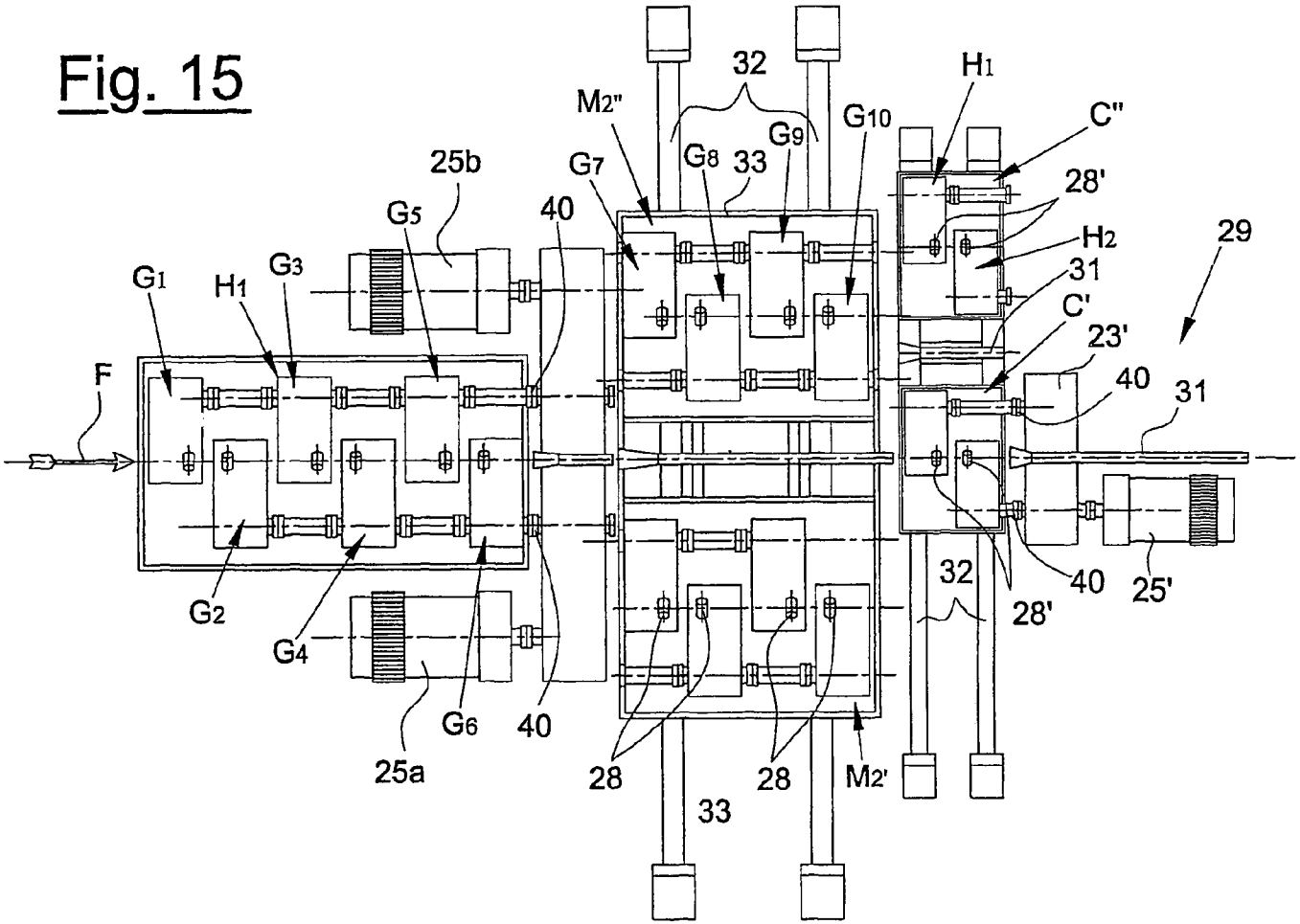
Figure 16:
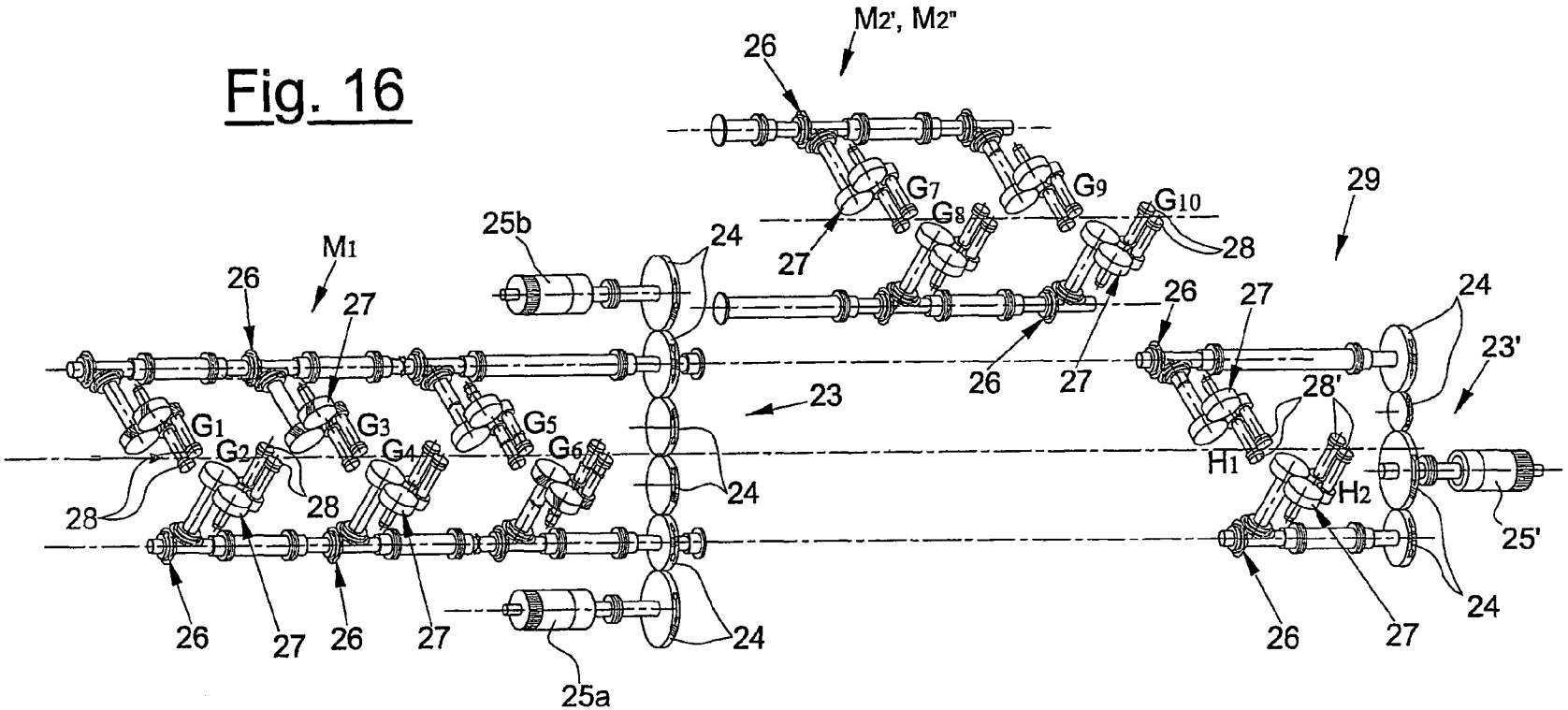
FIG. 16 is a schematic perspective view of FIGS. 13-15.

With reference to FIGS. 10 to 12, a calibrator 29 is illustrated that is made so that it can slide on guides 32 being supported by a trolley 33 and equipped with two identical calibration groups C' and C", and, arranged centrally, between the two groups C' and C", of a mouthed duct 31.

The function is substantially the same as that of the second modules M2' and M2", i.e. that of being able to be quickly exchanged to carry out maintenance, exchange of parts and adjustments without stopping the lamination line for long, as well as that of being able to be left out by making the wire rod pass directly into the central mouthed duct 31.

Between the aforementioned calibrator and the relative command reducer 23' there are advantageously the detachable joints 40 to allow the speed of the operations.

Such a calibrator is also able to slide on guides 31 through the trolley 33 that supports its groups C' and C".

Figure 18A:
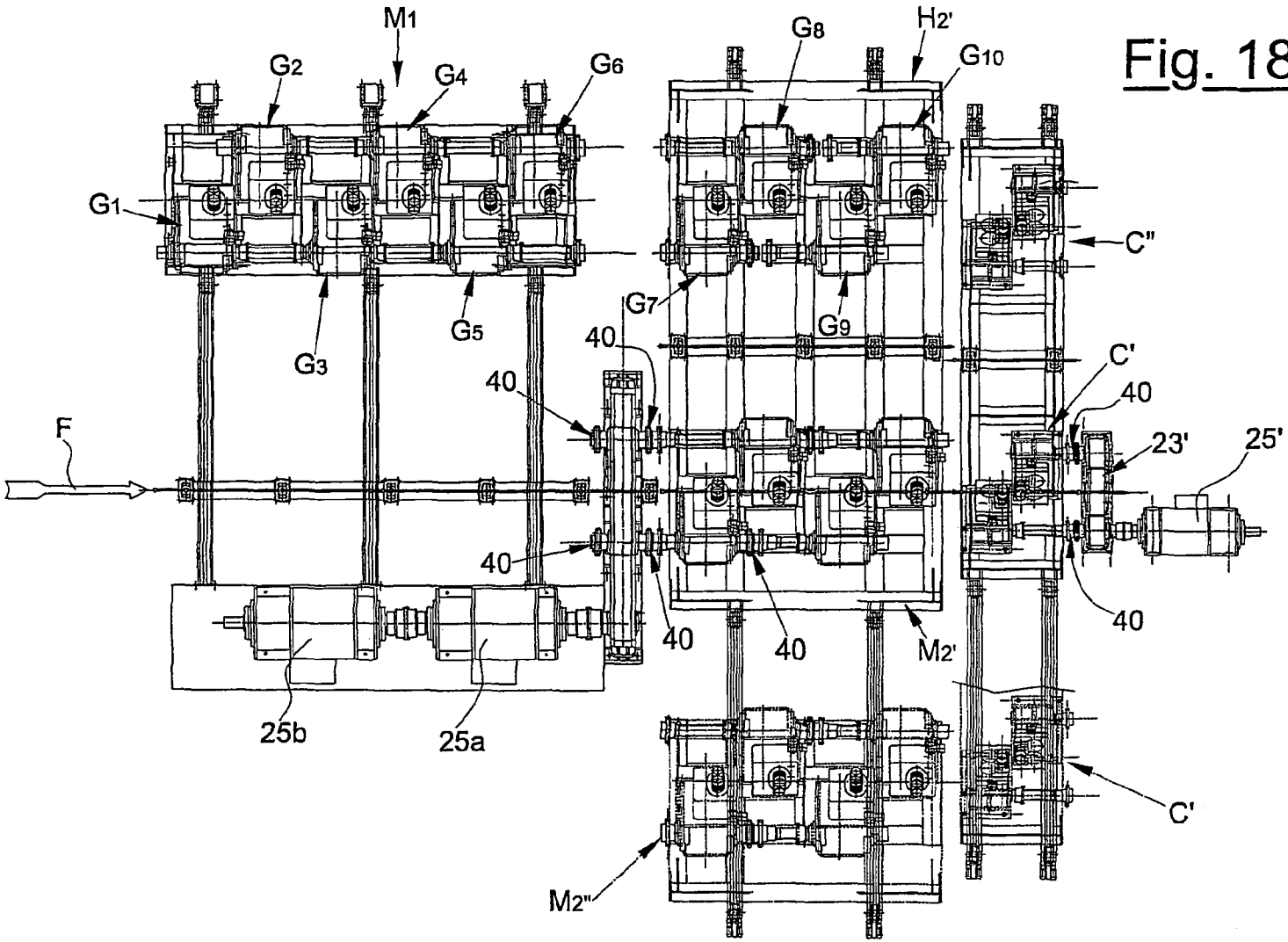
Figure 18B:
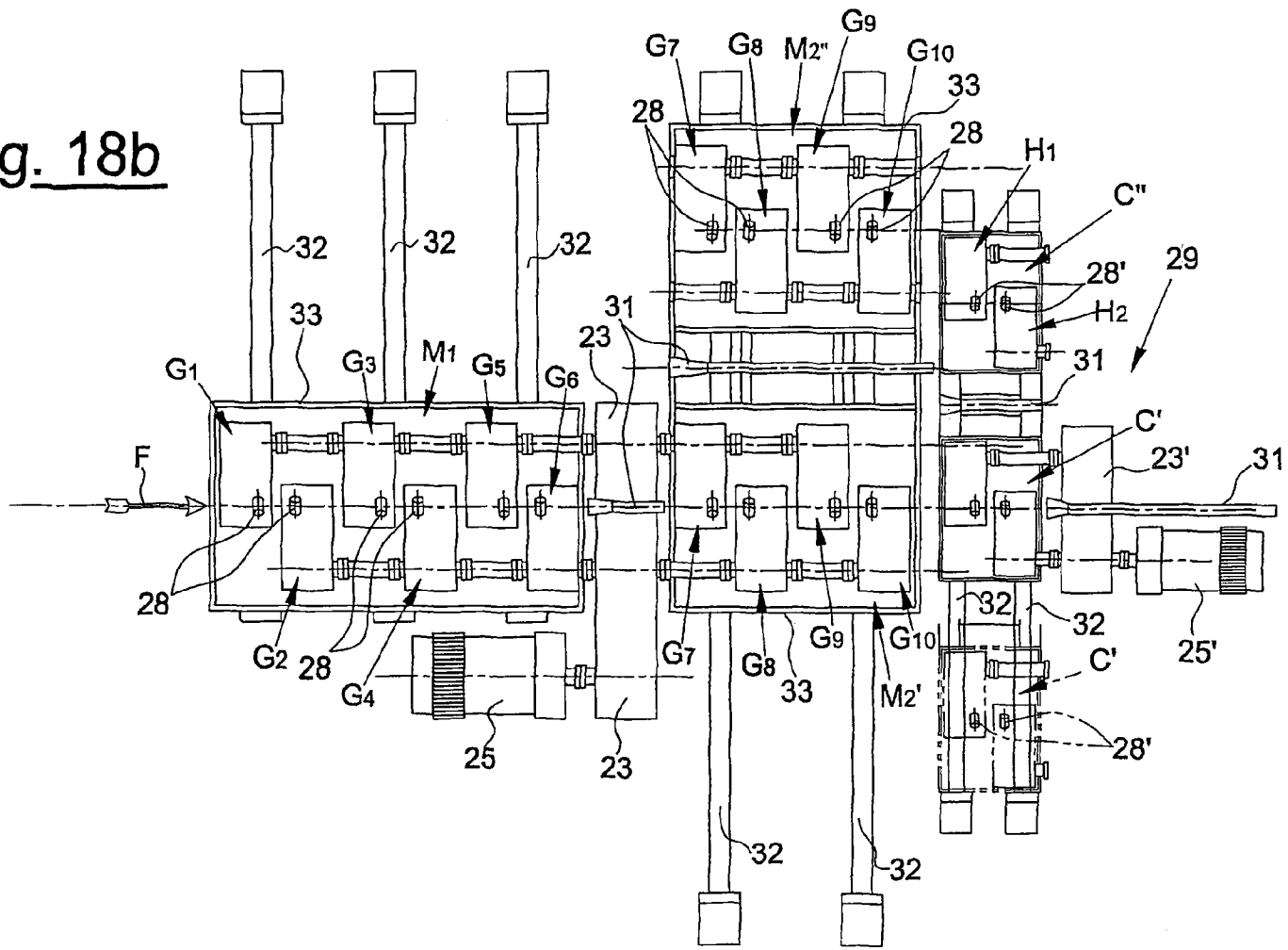
Figure 18C:
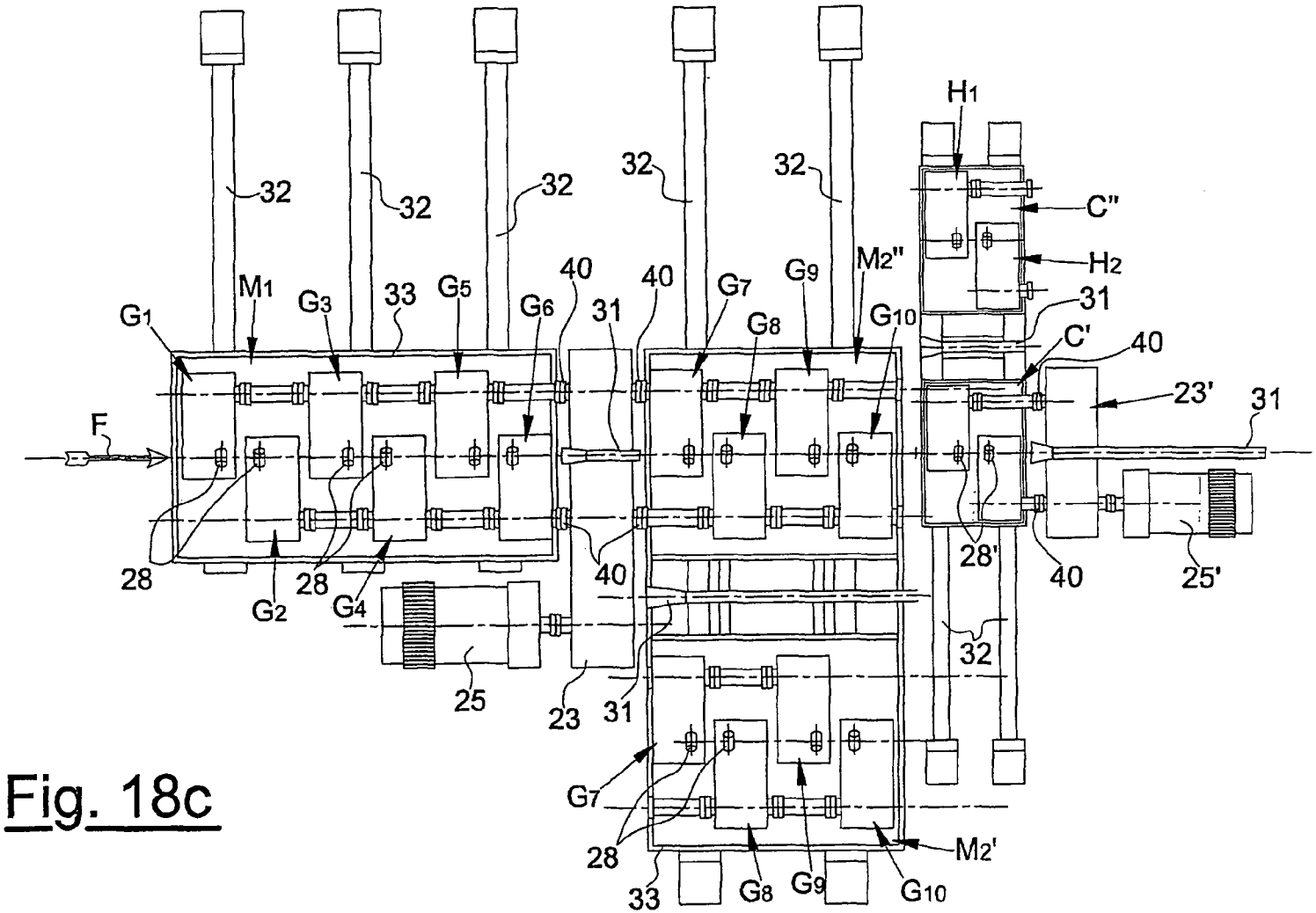
Figure 18D:
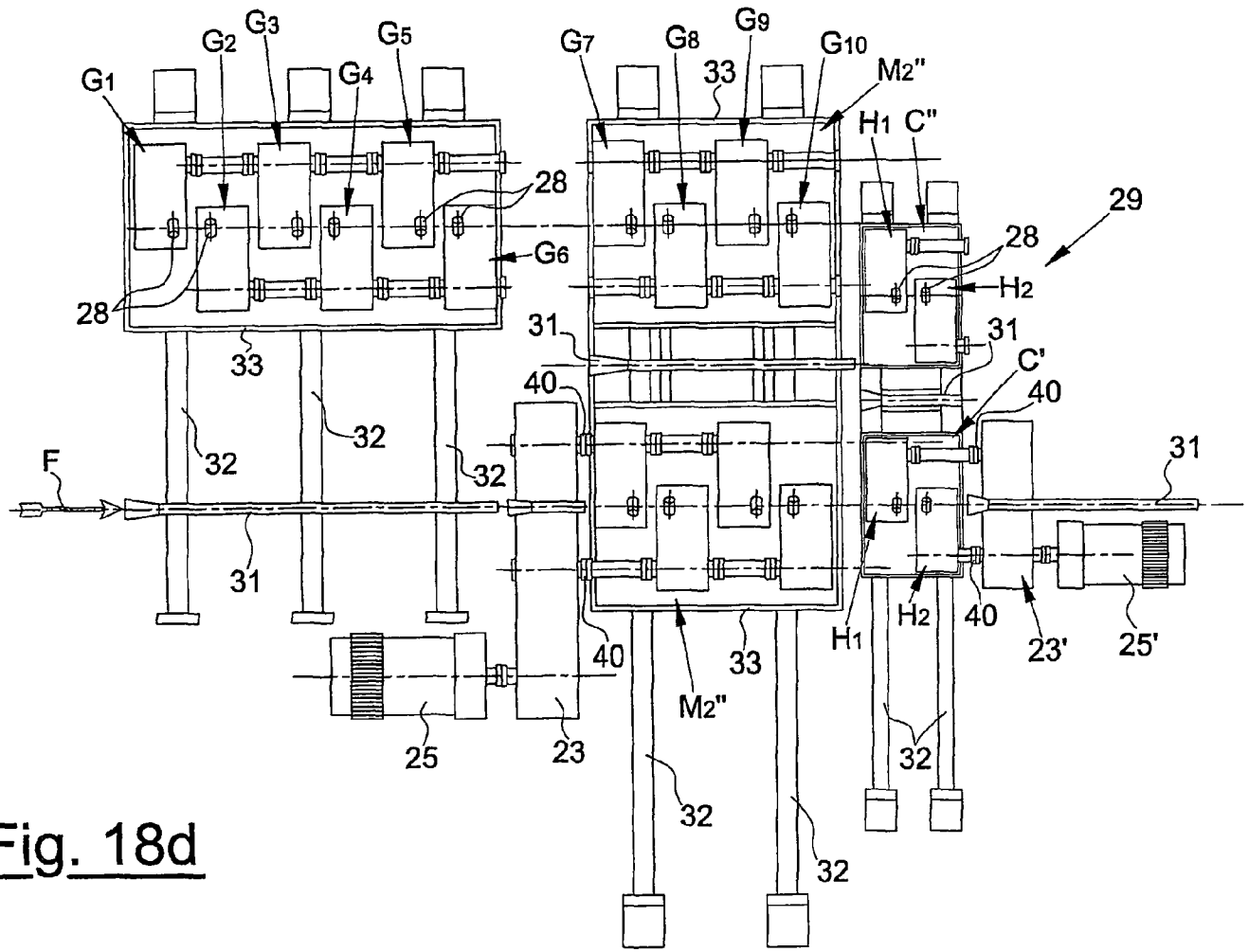

In a different embodiment of the invention illustrated in FIGS. 13 to 18*d*, the monoblock has the command reducer 23 arranged between the first module M1 and the second module M2', M2", connected to both through detachable joints 40, and actuated by a side motor 25 (FIGS. 18*b*-18*d*) with respect to the lamination line identified by the arrow F, or by two opposite side motors 25*a* and 25*b* (FIGS. 13-16) or by two side motors 25*a* and 25*b* arranged in series (FIG. 18*a*).

In such a way the maximum level of optimisation of production is obtained and it is indeed possible to completely stop the non-operative module be it the first module M1 or the second module M2', M2", to reach the maximum speed in the operating module.

The presence of a plurality of detachable joints 40 arranged between different lamination cages allows its disconnection and therefore the prolongation of the operating life of the unused cages.

The possibility of making the modules and/or the calibrator able to slide allows the stops of the lamination line for intervention to be reduced to the minimum.

Of course, the configurations described and illustrated should only be taken as examples and can be adapted as needed by modifying, combining and replacing its elements and adding others so as to make the plant as a whole extremely versatile and adaptable in order to optimise the operating parameters.

The proposed new monoblock has a command reducer arranged between the sixth and the seventh cage or else between the fourth and the sixth. It is thus possible to consider the group as consisting of two modules:

first module M1 arranged upstream of the command reducer 23;

second module M2', M2" arranged downstream of the command reducer 23.

Different combinations of the two modules are foreseen. For example, the second module can comprise 4 or 6 cages and foresee two groups of translatable cages.

When one group is in production the other is available for a change of the rollers and their complete adjustment to produce the next diameter.

Indeed, two detachable joints are foreseen, one for each of the main transmissions 22, 22' that allow the second module of the main reducer to be disconnected. Two detachable joints are also foreseen to detach the cages G9 and G10 from the transmission in the case of the group of 6+4 cages; or else to detach the cages 7-10 in the case of the group of 4+6 cages in the respective modules, so that if the finishing cage is the eighth G8, or else the sixth G6, the subsequent cages remain stopped.

At the end of the second module M2', M2" the lamination line foresees the calibrator 29 with the two cages H1 and H2 with round-round channels that in the case of round wire rod or of a round bar take care of increasing the precision of shape and the nominal size of the product and of recovering—i.e. taking back to the desired size—the initial and final parts of the skein of the wire rod that are larger or smaller in size due to the lack of shrinkage on the material during the passage of the top and bottom of the skein.

The first module M1 is foreseen in the case of a block for wire rod made up for example of 10 cages, with 6 or else 4 cages. It can be fixed or else translatable in relation to the production mixes. If large amounts of small round bar are produced the solution with 4 cages in the first fixed module and six cages on the second translatable modules may be suitable.

In the translatable solution the module or the group is mounted on the trolley 33 that is translated sideways by hydraulic cylinders or by cable systems.

The advantages of the present invention can be summed up as follows:

Increase in production as a consequence of the increased speed for all of the products that are finished starting from the eighth cage on a group with ten cages (i.e. eighth G8-sixth G6-fourth G4-second cage G2), such an increase can reach 30%.

Reduction of the stop times of the plant for changing the lamination rollers 28 for a change in diameter or due to wear of the channel of the roller in lamination, thanks to the fact that the changing of the rollers, of the apparatuses and the adjustment of the openings of the rollers are carried out off line. The relative times are more than 50% less.

Reduction in maintenance and longer lastingness of the bearings thanks to the containment of the maximum speeds and to a reduction of the time in which the machine (or the module) is operative turning freely.

Energy saving due to the possibility of keeping a module still when not used (when laminating with the first module, the second remains still or vice-versa).

Better dimensional tolerances (roundness and variations of diameters) on all of the diameters produced for the entire length of the skein of laminated thread.

Reduction of the outside-tolerance lengths of the top and bottom of the reel of thread obtained from a billet with a reduction of the waste from the current 0.8%-0.9% of production to values that reach 0.3%-0.4%. For a line that produces 300,000 T/year of wire rod there is a reduction in waste equal to or greater than 1500 T/year.

From what has been described above with reference to the figures, it is clear how a finishing monoblock for a billet lamination plant according to the invention is particularly useful and advantageous.

The purposes mentioned in the preamble of the description are thus achieved.

Of course, the monoblock according to the invention can be different to that described and shown just as a non-limiting example in the drawings.

The scope of protection of the invention is therefore defined by the attached claims.

The invention claimed is:

1. A finishing monoblock for a billet lamination plant, comprising:

a plurality of lamination cages arranged in sequence for forming a lamination line for lamination of a billet, said lamination cages being disposed in at least two modules including a first module and a second module;

a pair of mechanical transmissions for actuating said lamination cages and at least one command reducer for actuating said mechanical transmissions for the lamination of the billet;

a pair of detachable joints disposed between said first module and said second module and configured to selectively disengage at least one of said first and second modules from the lamination line;

said detachable joints being arranged along said mechanical transmissions for enabling quick disconnection and reconnection of said first module with said second module;

said second module including a first series of lamination cages and a second series of said lamination cages; and said second module being slidable to allow said first module to be quickly disconnected and reconnected to said first series of lamination cages and alternately to said second series of lamination cages.

2. The finishing monoblock according to claim 1, wherein at least one of said first module and second module is configured to translate between an operative position and a non-operative position.

3. The finishing monoblock according to claim 1, wherein said first series of cages and said second series of cages are slideably mounted on guides supported by at least one trolley.

4. The finishing monoblock according to claim 1, wherein said detachable joints are arranged between cages inside each module so as to be able to disinsert any combination of cages from the lamination line.

5. The finishing monoblock according to claim 1, wherein said command reducer is arranged between the first module and the second module being connected to both through detachable joints.

6. The finishing monoblock according to claim 1, which comprises a side motor, with respect to the lamination line, for driving said command reducer.

7. The finishing monoblock according to claim 1, wherein said command reducer is actuated by two motors arranged laterally with respect to the lamination line.

8. A lamination line, comprising a monoblock according to claim 1.

9. The lamination line according to claim 8, which comprises a calibrator disposed downstream of said finishing monoblock, said calibrator including two calibration cages and relative apparatuses comprising said mechanical transmissions actuated by its own command reducer in turn connected through gears to a work driving motor, for the transmission of the rotation to calibration cylinders with the presence of pairs of conical gears and gears, said calibrator groups being able to be disengaged from the command reducer, or from the lamination line, through a pair of joints.

10. The lamination line according to claim 9, wherein said calibrator includes two identical calibration groups and a mouthed duct arranged centrally between the two calibration groups, and said calibrator is able to slide on guides supported by a trolley.

* * * * *